US005398877A

United States Patent [19]

Xiangzhi

[11] Patent Number: 5,398,877

[45] Date of Patent: Mar. 21, 1995

[54] MULTI-DISC REFINER WITH FREE FLOATING PLATE MECHANISM

[75] Inventor: Kong Xiangzhi, Ji Nan City, China

[73] Assignee: Global Technologies Group, Minneapolis, Minn.

[21] Appl. No.: 88,680

[22] Filed: Jul. 9, 1993

[51] Int. Cl.[6] ..... B02C 7/14

[52] U.S. Cl. ..... 241/163; 241/261.3; 241/288; 241/289; 241/297

[58] Field of Search ..... 241/163, 261.2, 261.3, 241/287, 288, 289, 290, 297

[56] References Cited

U.S. PATENT DOCUMENTS 4,531,681 7/1985 Matthew et al. ..... 241/146
4,586,662 5/1986 Goldenberg et al. ..... 241/102
4,614,309 9/1986 Goldenberg ..... 241/163
4,625,926 12/1986 Kirchner ..... 241/261.2
4,783,014 11/1988 Frederiksson et al. ..... 241/261.2

*Primary Examiner*—John Husar

*Attorney, Agent, or Firm*—Jerry Cohen; Harvey Kaye; Ed N. Paul

[57] ABSTRACT

Apparatus for reducing particulate materials such as paper-making pulp, including a housing defining a working chamber having an inlet and an outlet for flow of particulate material therethrough. There is a rotary shaft supported in said housing, and rotors and stators are mounted on the shaft within said working chamber. Radially extending annular rigid refining surfaces are mounted on the outer portions of the rotor plates and stator plates and the rotor plates and stator plates provide complementary rigid refining surfaces mounted in the chamber and cooperating in confronting relation with the refining surfaces so that in the relative rotation of the refining surfaces particulate material flowing through the working chamber and between the refining surfaces is refined. The refining surfaces are capable of having a wobbling motion with respect to the portions of the plates mounted on the shaft.

17 Claims, 8 Drawing Sheets

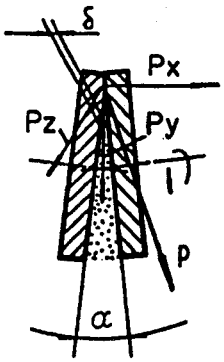
FIG.3A
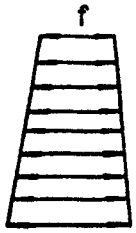
FIG.3B
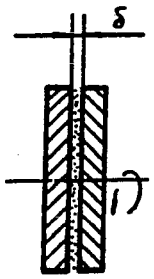
FIG.4A
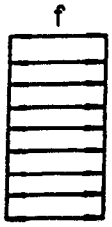
FIG.4B
delta PARAMETER IN PULP BEATING
| RATIO PRESSURE IN PULP BEATING | PULP BEATING METHOD | DISTANCE OF DISK (mm) |
|---|---|---|
| SMALL | LIGHT SEPERATING | 0.6~1.0 |
| SMALL | HEAVY SEPERATING | 0.5~0.6 |
| SMALL | LIGHT BEATING | 0.2~0.4 |
| MIDDLE | MEDIUM BEATING | 0.1~0.2 |
| GREAT | HEAVY BEATING | <0.1 |
FIG.5

FIG.6A
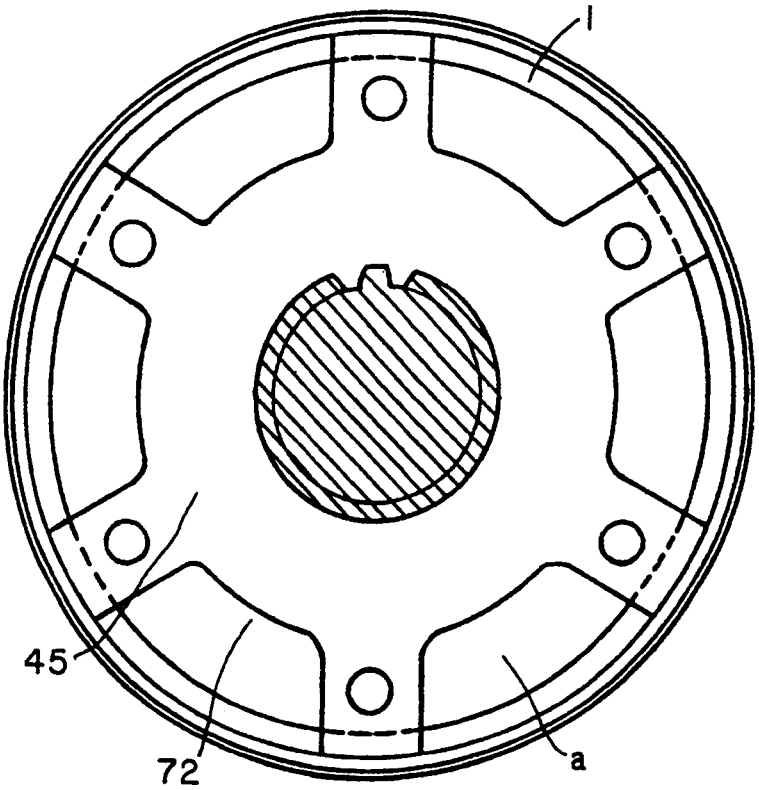
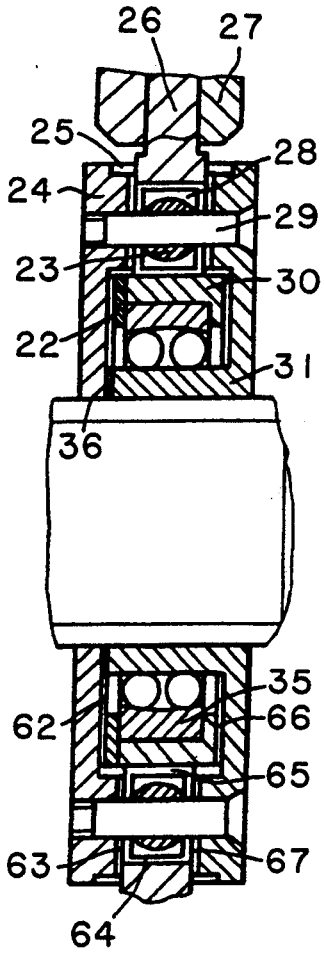
FIG.6B
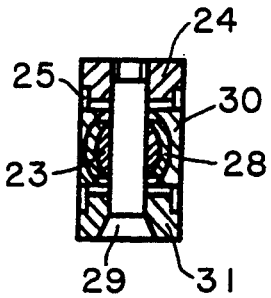
FIG.6C

FIG.7A
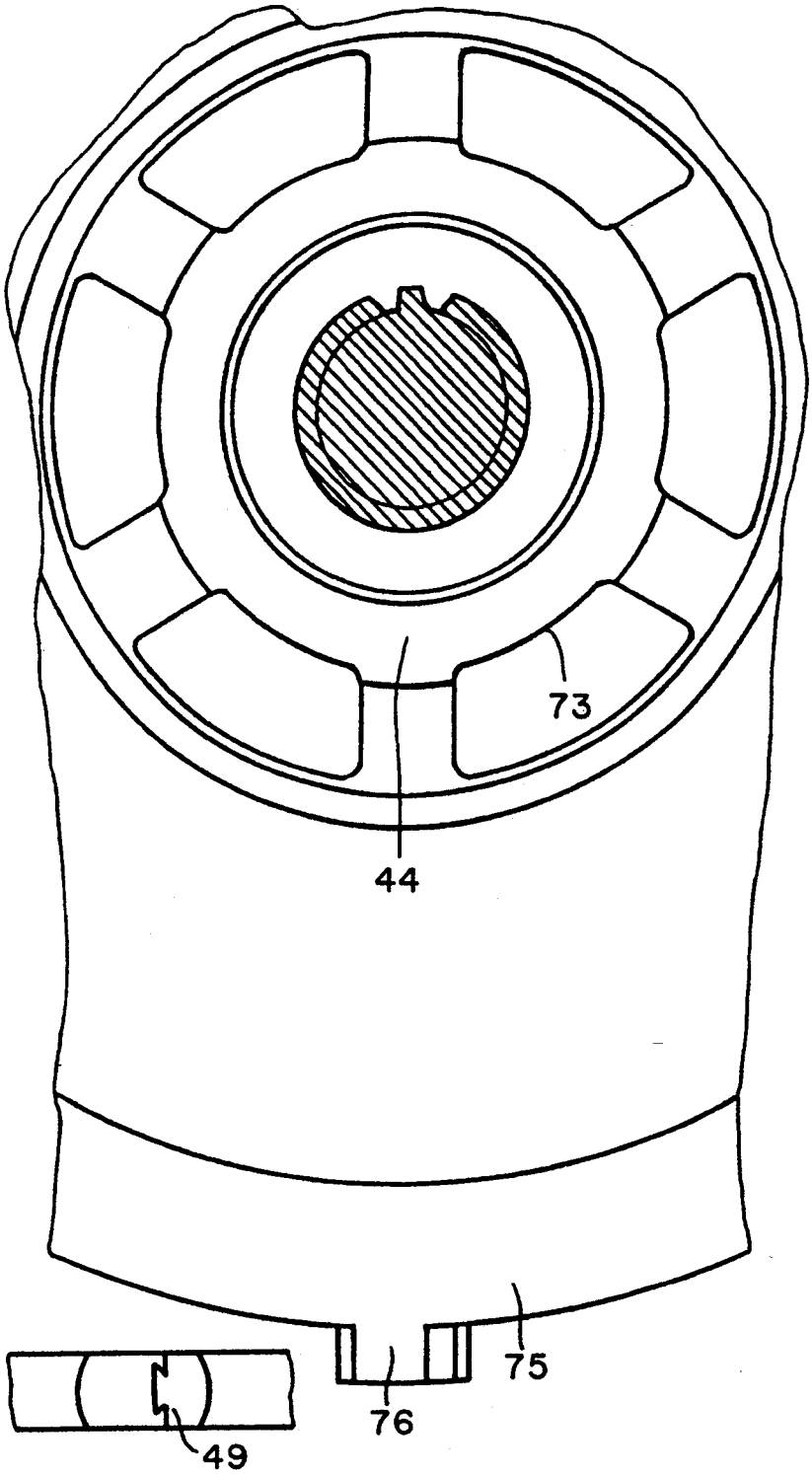
FIG.7C
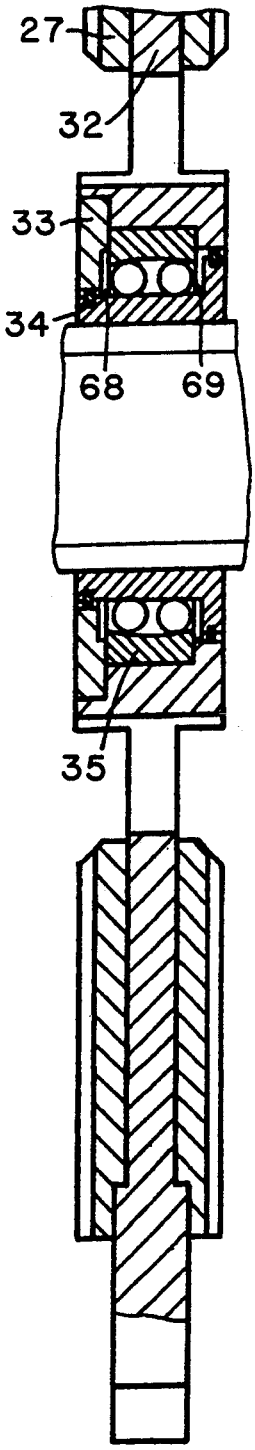
FIG.7B

MULTI-DISC REFINER WITH FREE FLOATING PLATE MECHANISM

The present invention relates generally to the paper making art, and, more particularly, to a multi-disk refiner with a free floating plate mechanism which has multiple, movable plates.

BACKGROUND OF THE INVENTION

Refiners in the paper making art are used to break up the fibers and sparate them so that they can be processed into paper.

The multi-disk refiner of the present invention is different from the structure of the Beloit disk refiner, such as the one disclosed in U.S. Pat. No. 3,371,873, as well as others.

U.S. Pat. No. 4,531,681, provides a refiner for a paper-making line in which the working surfaces of the refiner are mounted on plates which are resiliently flexible in an attempt to provide for automatic adjustment of the gap.

In U.S. Pat. No. 4,620,675, a bonding agent is used for mounting the working surfaces onto the plates.

U.S. Pat. No. 4,570,862, discloses a multi-disk arrangement in which ports through the plates assist in balancing the pressure on opposite sides of the plates, using vanes associated with the ports.

In U.S. Pat. No. 4,614,309, there is disclosed a refiner in which there are rigid links each having one end pivotally secured to the rotor and the other end pivotally secured to one of the rotor plates, and there is a similar arrangement using rigid links for supporting the stator plates in position, while still providing some axial movement capability.

U.S. Pat. No. 4,586,662 discloses a multi-disk refiner using confronting rotor and stator plates to abrade a stock suspension passing through the space between such plates, and a plurality of flexible rotors are provide having spokes extending therefrom. The spokes are received in slots in a loose fit to permit relative sliding movement between the spokes and the rotor plates while transmitting torque. There is a resilient bumper on each spoke to provide a pivot within the slot so that axial movement of the rotor plates provides a simple bending load to each spoke and defining a soft, linear spring system.

In U.S. Pat. No. 4,625,926, there is a multi-disk refiner in which there is a rotor structure mounted on a hub for rotation with it, and resilient coupling means are provided which connect the rotor with the rotor plates, and the coupling means include a resiliently deformable elastomer intended to deform in a shearing mode to allow for increased axial deflection of the rotors and operation at a higher intensity level.

U.S. Pat. No. 4,619,414 is intended to be an improvement over U.S. Pat. No. 4,531,681, to have increased axial flexibility.

The subject matter of U.S. Pat. No. 4,661,911 deals with adjusting the intensity of the stock in the refiner to better control the process, such as by use of a variable control drive.

U.S. Pat. No. 4,783,014, provides a refiner structure in which more plates may be added.

In U.S. Pat. No. 5,046,672, there is a pulp treating refiner which is intended to treat long fibers in a slurry of pulp while minimally treating short fibers present.

BRIEF SUMMARY OF THE INVENTION

One object of the present invention is to provide a refiner for a paper making machinery line in which the main shaft transmits primarily rotating, but not bending or shearing, stresses.

Another object of the present invention is to provide a refiner in which the average length of the fibers is 200–300% greater after beating and grinding compared with conventional technology.

A further object of the present invention is to provide for beating in which the degree of pulp beating can be raised to 7-16SR.

Yet another object of the present invention is to provide a machine in which the quality of the pulp remains stable over the life span of the disks.

Still another object of the present invention is to provide a refiner for paper making in which the structure is simple which makes it easier to achieve standardization of the components.

Yet a further object of the present invention is to provide a refiner which can reduce the energy consumption by 10–15% compared with current technology machines.

Another object of the present invention is to provide paper making machinery in which it is easy to mount, maintain, and change working parts of the refiner and especially the disks and plates.

A further object of the present invention is to provide that the structure of the grinding mechanism does not produce fiber amassing or agglomerations and no stagnation of the pulp flowing in the housing.

Yet another object of the present invention is to provide paper making machinery in which the cost of manufacture is low.

The present invention relates to apparatus for refining paper-making stock including a working chamber having an inlet and an outlet. A rotor assembly of rotating plates and a stator assembly of non-rotating plates within the working chamber, provide for axially spaced refining surfaces arranged on the rotor plates and the stator plates. A working annulus is carried on the plates in the form of refining surfaces. Axially spaced refining surfaces are mounted on the plates, and there is an inlet providing stock into the interior of the plates and refining surfaces, and the outlet is located at the outer periphery of the chamber for collecting separated stock after it has passed between the working surfaces on said plates.

The theory of the present flexible multi-disk refiner could be easily transmuted to other types of mechanical equipment requiring the function of flexible and center adjustability. For example, the center adjustable flange plate, coupling, and cross joint.

Furthermore, these advantages are provided by the present invention:

1. There is little axial stress on the floating mechanism, which means only the main shaft transfers torque, but little bending moment or shear stress.

2. The distance of the disk surface can be accurately controlled, so the pulp beating pressure ratio, which is important to the quality of the pulp, can be controlled.

3. The degree of beating of every pair of disks can be raised by 7-15 SR (if multi-stage refining, the degree of beating can be raised by the stage number times another parameter) [SR is a term used in China which stands for Schopper Riegler. In the US and Canada the term "CSF" (standard cc freeness) is used.].

4. The structure of the refiner is simple and standardization of the parts can be easily achieved.

5. The whole assembly is compact and the ground area occupied (footprint) is reduced.

6. Easy mounting, maintenance and changing of parts.

7. Low cost.

Other objects, features and advantages will be apparent from the following detailed description of preferred embodiments taken in conjunction with the accompanying drawings in which:

BRIEF DESCRIPTION OF THE DRAWINGS

FIGS. 3A and 3B are explanatory views of prior art plate type refiners.

FIGS. 4A and 4B are explanatory views of the plate type refiners according to the present invention.

FIG. 5 is a chart.

FIG. 6A is a side elevational view of a rotor plate.

FIG. 6B is a vertical sectional view of the rotor plate of FIG. 6A.

FIG. 6C is a vertical sectional view of the pin and surrounding structure of the rotor plate.

FIG. 7A is a side elevational view of a stator plate.

FIG. 7B is a vertical sectional view of the stator plate of FIG. 7A.

FIG. 7C is an elevational view of a portion of the outer periphery of the stator plate.

DETAILED DESCRIPTION OF THE PREFERRED EMBODIMENTS

Figure 1:
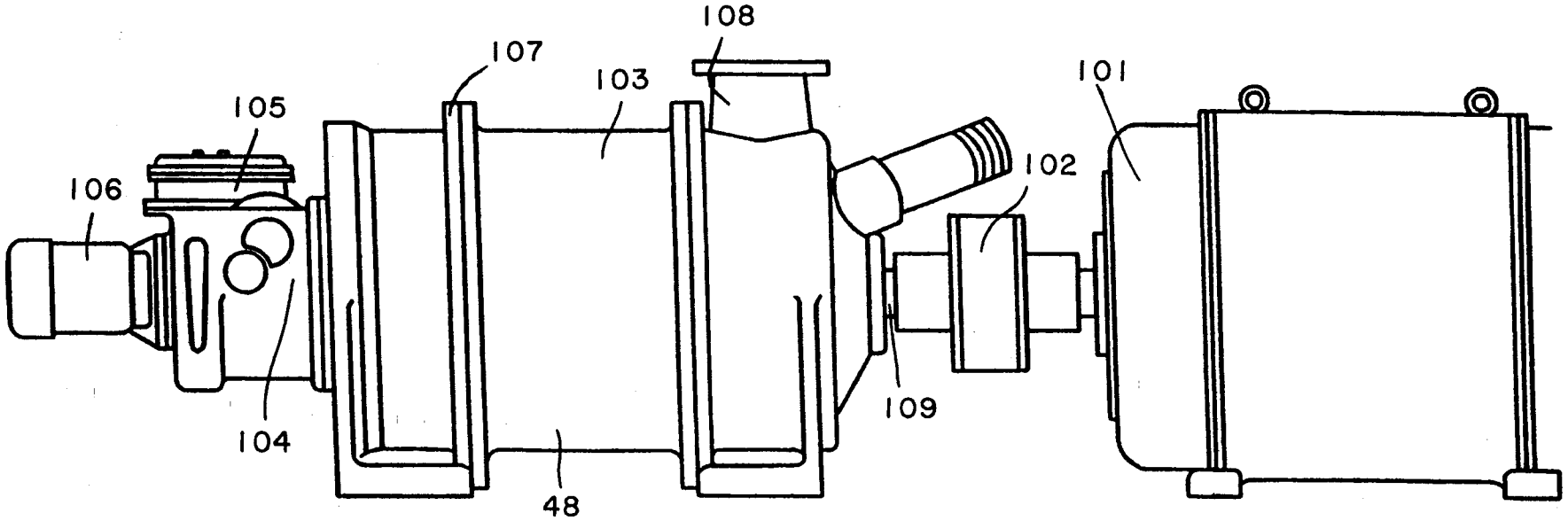
FIG. 1 is an elevational view of the entire refiner.

The main parts of the system include a main motor 101 (FIG. 1), which is the driving device for this refiner. A coupling 102 transfers motion from the motor 101 to the main shaft 109. The coupling 102 has a large torque tolerance, impact buffering and automatic center adjusting function. The main machine assembly 103 is the working part of the refiner where the pulp is broken up and reduced in size, and will be discussed in more detail below.

The feeding pressurizer 104 is driven by the feeding motor 106 and drives the plates (described below) inside of machine assemby 103 together.

The micrometer control mechanism 105 is driven by a bevel gear shaft of the feeding pressurizer 104 through the driving shaft of the micrometer. This mechanism can measure and control the clearance of the confronting working surfaces of the plates.

The feeding motor 106 is a standard product. It is a variable three phase motor with two velocities (2900 rpm and 720 rpm), so the pressurizer can produce two velocities; automatic feeding 0.0227 mm/s; automatic unloading 0.0933 mm/s. The machine assembly 103 has a middle housing 48 which has a front end seat 107 and a tail end seat 108.

In a traditional refiner, the plate assembly does not have free wobbling movement because of the fixed or flexible connection between the plate assembly and the main shaft. Because of the manufacturing error, mounting error and transformation, the plates of a refiner can not maintain a perfectly parallel position, so an angle $\alpha$ (alpha) is formed (see FIG. 3A). A clearance $\delta$ (delta) (see table of FIG. 5) must be preserved to fit pulp beating and grinding specifications, so a contacting surface must be prepared at the outer ring of the plate or disk in order to maintain a large working area at a clearance of $\delta$ (delta) or so in the traditional refiner. So a frictional force P will be produced at the contacting surface when the plate rotates. Force P could be separated as: Px—Axial force; Py—radial force; Pz—tangent force.

A flexible connection between the plate and shaft has been adopted in some prior patents, but this structure also could not obtain the free wobbling function, compared with the traditional technology. In one patent there is an improved "stress distribution," but it still cannot attain an optimum parallel position. The stress is distributed in trapezoidal shape (see FIG. 3B). The plate mechanism in the present invention has a free wobbling function, under the equalized pressure in the refiner, the free floating (wobbling) plate will be maintained in an optimum position automatically at working conditions; they are parallel. The stress distribution is rectangular (see FIGS. 4A and 4B).

As a result under working conditions the main shaft is only under an axial force. The main shaft is under a friction force, comparing the two loading conditions (ignoring gravity) there is little bending and shearing stress on the main shaft.

Figure 2:
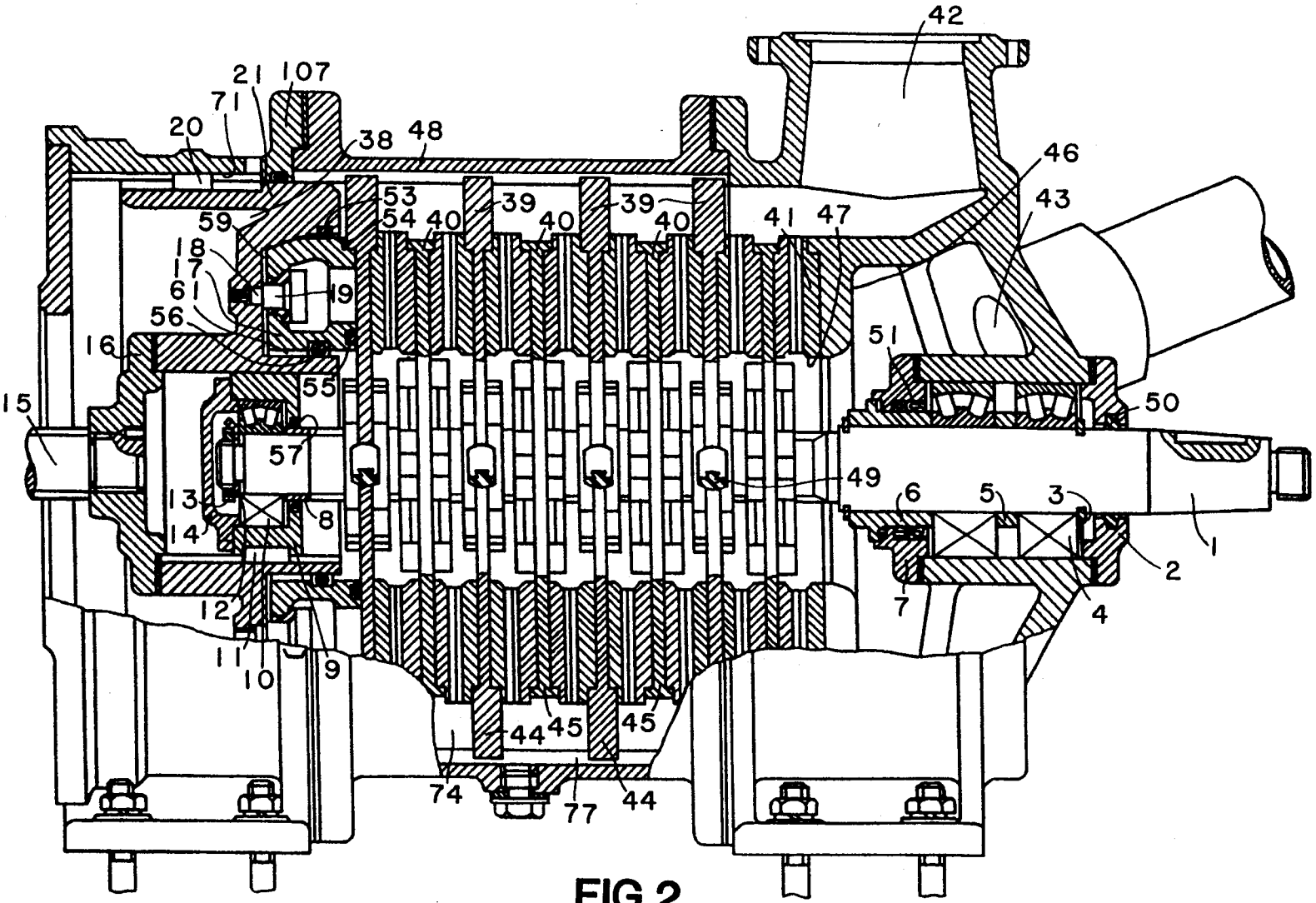
FIG. 2 is a cross sectional view through the center of a refiner constructed in accordance with the present invention.

Pulp beat is a complex physical and mechanical process. The squeezed and rotary disk will exert squeezing, friction, shearing, impacting and stressing on the pulp, so fiber will be bent, torque rotated, torn, scattered and split. The physiclal property has been changed to fulfill paper making specifications. There is an angle a (alpha) between the plates in the traditional refiner. This makes the pulp sheared severely and fiber will be cut, so the fiber length is greatly reduced. Shearing will be smaller compared with squeezing friction impacting and stressing so fiber length is longer than traditional technology and the quality is also superior t to the traditional one. Comparing the pulp beating results one finds that fiber length is raised by 200–300% in the present invention compared to traditional refiners A number of mechanisms are mounted in the housing 48 as can be seen in FIG. 2. There is a floating plate pushing mechanism 17 for pressing the disks and the plates closer together against the pulp. A floating plate stator assembly 39 includes a number of stator plates 44 which are mounted on the spline shaft 1, which is connected to main shaft 109, for wobbling movement, but not rotational movement in the direction of rotation of the shaft 1. A floating plate rotor assembly 40 includes a number of rotor plates 45 which are mounted on the spline shaft 1 for wobbling movement, as well as rotational movement, in the direction of rotation of the spline shaft 1 to which they are connected. There is a fixed plate 41 through which the spline shaft 1 extends. This shaft is positioned along the center axis and is connected for rotating movement with the main motor drive shaft 109. The fixed plate 41 is fastened to the inner end of the tail end seat 108 and the position is fixed.

The floating plate pushing mechanism 17 is installed in the opening 71 of the front end seat 107 and can move in the axial direction under the control of the plate feeding pressurizer 38. This mechanism can make the stator plate 44 mounted on its inner side wobble around its own spherical center, but there is no rotating movement.

The spline shaft 1 is supported at its tail end in double lined centripetal ball beating 4 and bearing cap 2 and resilient ring 3 are also used. A bushing 5 assists in the bearing function. A comb seal 6 is provided for isolation of lubricants. At the other end there is another bearing cap 7 having a maze seal. The other end of the spline shaft (see FIG. 8) 1 is supported in double lined centripetal ball bearing 10 and bearing cap 14. A bushing 8 assists in the bearing function, and there is also a bearing bush 9. At the end of spline shaft 1 there is a snubber washer 12 for the ring nut 13.

Figure 10A:
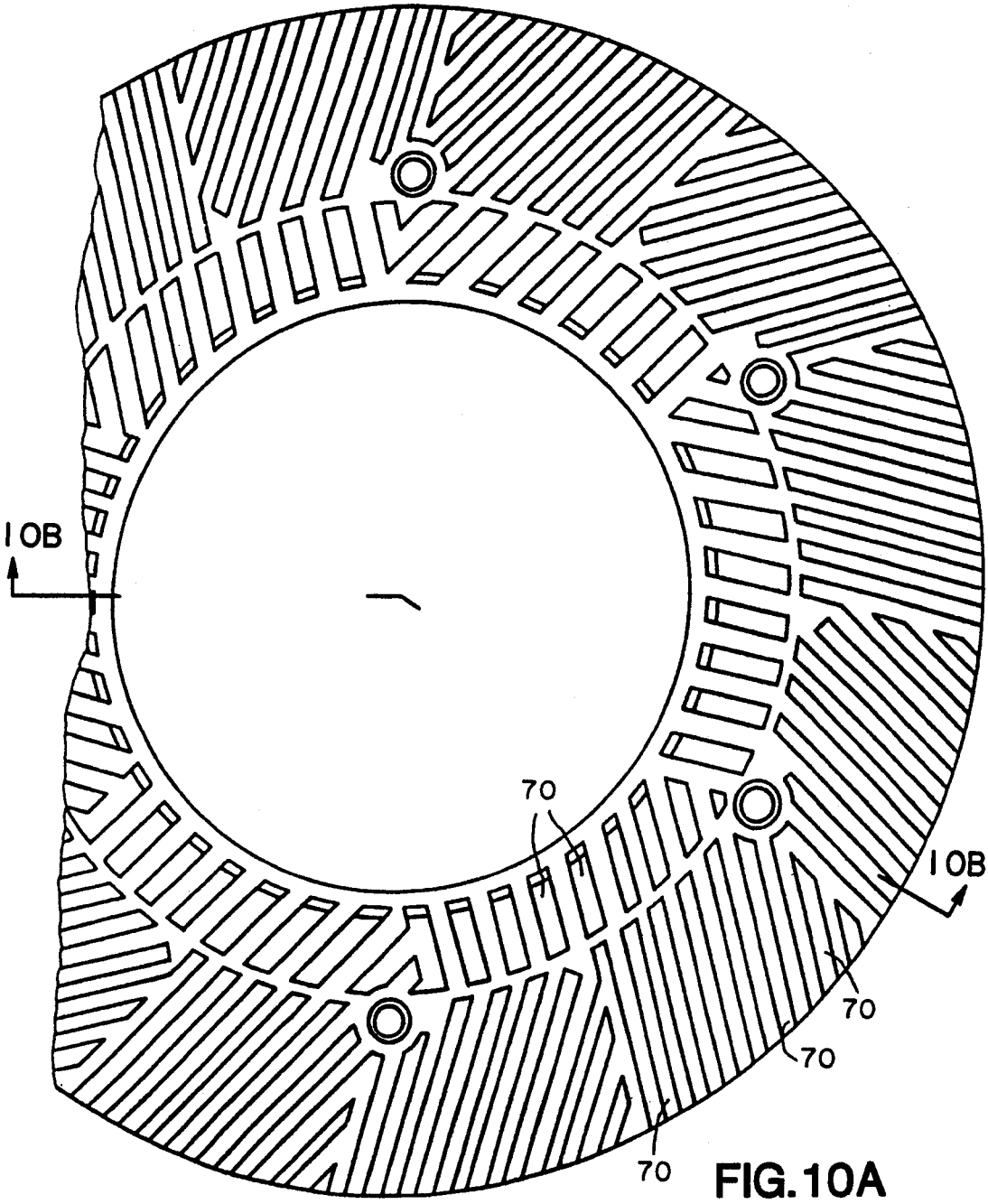
FIG. 10A is a partial elevational view of the working surface of a disk which is mounted onto a plate.
Figure 10B:
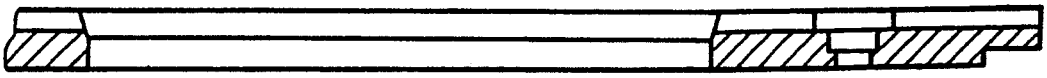
FIG. 10B is a sectional view taken substantially along the plane defined by reference line 10B—10B of FIG. 10B.

The disks attached to the plate assembly described above have the same size and ring shape, see FIGS. 10A and 10B, and are manufactured with fixed outstanding bars or ribs 70 on their working faces so quite a few pulp grinding areas are formed on and between the work faces of the disks. A relative rotational movement can be achieved between the disks attached to the sides of the floating rotor plates 45 and the disks attached to the sides thereof, and the disks attached to the sides of the fixed plate 41 when the floating plate rotor assembly 40 is rotated by the driving spline shaft 1, so the pulp beating and grinding process can be carried out.

During pulp beating and grinding, pressurized pulp fills in the space of the housing, and transfers an equalized pressure in every direction. With the wobbling function the "floating" plates can achieve an optimum parallel state with respect to the work faces of the stator plates 44 under the pressure of the pulp.

There are a few sector shaped passage ways 72 and 73 on the spokes of the floating rotor plates 45 and the floating stator plates 44, respectively (as shown in FIGS. 6 and 7). The floating plate pushing mechanism 17 has no passage ways on its spoke. The pulp-feeding pipe 43 (FIG. 2) is located on the side section of the tail end seat 108 and the output 42 is located on the tip of the tail end seat 108. The feeding pipe 43 and the output or unloader 42 are separated from one another.

Pulp is loaded into the inner space of the tail end seat 108 through the feeding pipe 43. It passes through the opening 47 of the fixed plate 41, through the sector shaped passage ways 73 and 72 on the spokes of the floating plate rotor and non-rotatable (stator) asemblies, and then reaches the work faces of the plates. After grinding, the pulp flows into the annular space near the inside wall of the middle housing 48, and then flows to the unloader 42.

The spline shaft i is stretched out from the tail end seat 108 and connected to the main motor 101 through the pin coupling 102.

With power supplied by the variable motor, the feeding pressurizer 104 can make the floating plate pushing mechanism 17 move in the axial direction through the screw bar 15 placed in the front end seat 107. Because of the function of the free movement in axial direction, the floating plate rotor assembly 40 and the floating plate stator assembly 39 can move in the axial direction on the spline shaft i under the pressure of the pulp located between the working surfaces of the disks 27 (FIGS. 6B and 7B).

Under working conditions, the clearance between the working faces of the disks 27 can be controlled by the micrometer control assembly 105.

The micrometer control assembly 105 controls the precision of the feeding movement and the clearance of the workfaces of the disks 27 of the plates to as small as 0.001 min.

The spline shaft 1 has two supports in the shell assembly 48 and end seats. The spline shaft 1 is supported at the two sides of the floating plate mechanism and the position is fixed. One support is the double lined centripetal ball bearing 10 which supports the spline shaft 1 at the front end, and the other is the double lined centripetal ball bearing 4 which supports the spline shaft 1 at the tail end.

The shaft, including the parts attached to it, is a suspension structure in the shell assembly of the plate refiner, in which the two supports in the refiner are outside of the shell assembly and end seats.

The position of the support 10 at the end of the spline shaft 1 is in the opening 71 of the floating plate pushing mechanism 17 seated in the front The shaft, including the parts attached to it, is a suspension structure in the shell assembly of the plate refiner, in which the two supports in the refiner are outside of the shell assembly and end seats.

The position of the support 10 at the end of the spline shaft 1 is in the opening 71 of the floating plate pushing mechanism 17 seated in the front seat 107 and is fixed when the floating plate pushing mechanism 17 moves in the axial direction. The position of the support 4 at the other end of the spline shaft 1 is in the center 47 of the tail end seat 108.

The floating plate rotor assembly 40 includes the floating rotatable hub 30, rotatable plate 45 and the two ring shaped disks 27 fastened to both sides of the plate 45 (FIGS. 6A, 6B and 6C). The floating rotatable hub 30 includes the following parts: double lined centripetal ball bearing 35 with an end cap 24 on the inner ring of the bearing with end plate 31; a few radial distributed cylinder bearing hubs 30 are distributed on the outer ring; end cap 24; half cylinder pins 28 mounted in the blind hole in the bearing hub 30 in the axial direction of the cylinder; the ball with a hole 23 mounted in the spherical recess formed by the two half cylinder pins' 28 confronting surfaces with a half spherical hole; the conical pin 29 across the hole of the ball with the hole 23 has a conical fit with the end plate on the inner ring of the bearing and a cylindrical thread fit with the end cap 24 to tighten the outer ring of the bearing.

There is an adjusting washer 36 for the size of the clearance for floating (wobbling). The inner ring 31 of the double lined centripetal ball bearing is a spline opening and matching with the spline on the shaft 1. The cylindrical pin formed by the two half cylinder pins 28 has a clearance fit with the blind hole in the bearing hub 30 in the radial direction of the cylinder. The matching between the ball 23 with a bore and the spherical opening formed by the half cylinder pin 28, the conical pin 29 and the hole of the ball with a hole 23 is also clearance fit.

The end plate, the inner ring of the double lined ball bearing 31, and the end cap 24 are integrated into a body "a" tightened by the conical pin 29 and adjusting washer 36. In the body "a" the outer ring of the double lined centripetal ball bearing 31 and the bearing hub 30 are integrated into another body "b" by pressure cap 22. There is a particular clearance (62, 63, 66, 67) between the two pairs of the confronting surfaces of the bodies "a" and "b". The length of the cylindrical pin formed by the two half cylinder pins 28 is less than the length of the blind hole matching to it, so a particular clearance (64, 65) is also formed between the two fitting surfaces 30 and 28.

The top surface of the radial directional cylinder of the bearing hub 30 forms a non-continuous cylinder surface, and has a tight fit with the opening of the rotor plate 45 and bearing hub or bushing 30.

Thus, the parts 24, 36, 31 and 29 constitute body "a" and parts 22 and 30 and the outer ring of the ball bearing constitute body "b."

The rotory movement is transferred to body "a" by the spline shaft 1, then to body "b" by "a", conical pin 29, holed ball 23 and half cylinder pin 28, then to plate 45 and the disk 27 to it.

The axial movement of the floating plate rotor assembly 40 is obtained through the spline fit of the inner ring of the bearing and the spline shaft 1.

From the mounting position and the fitting relation of the parts, the ball with a hole 23 can move in the direction of the axle of the conical pin 29; this is the X-Axis movement. The ball with a hole 23 together with the half cylinder pin 28 can move in the direction of the axle of the blind hole on the radial distributed cylinders on the bearing hub 30; this is the Y-axis movement. The rotory movement around the X-axis and Z-axis could be achieved by the ball with a hole 23 seated in the opening formed by the two half cylinder pins 28.

With the aforementioned four-way movement available, the pressure of the pulp fed into the chamber and against the working surfaces of the plate body "b" would obtain a universal floating or wobbling around the center of the double lined centripetal ball bearing 31. The wobbling range of body "b" is the particular clearance 62, 63, 65, 66) of body "a" and "b". This clearance assures that the ting shaped disks 27 remains parallel during working conditions.

Between body "a" and "b", there is a particuliar sealing ring 25 fitted in the circumference of both sides of the clearance. The particuliar sealing ring 25 is made of resilient material. Sealing glue is used between the confronting surfaces and the ring when mounting the ring. An initial pressure P1 is applied after mounting. The sealing frame could also reset the floating body "b" by its elastic force.

The space at both sides of the radial cylinder of bearing hub 30, the space between the hole of the ting shaped disk 27 and the other ring of the bearing hub 30 forms the passage way for the pulp.

The floating plate rotor assembly (See FIG. 2) includes the floating rotatable hub, rotor plate 45 and the two ting-shaped disks 27 fastened to both sides of plate 45. The floating rotatable hub includes the following parts:

double spherical centered bearing 31 with an end plate 24 on the inner ring;

a few radially distributed cylinder bearing hubs distributed on the outer ring;

end cap 24;

half cylinder pin 28 mounted in the blind hole in the bearing hub 30 in the radial direction of the cylinder;

the ball 23 with the hole mounted in the recess formed by the two half cylinder pins' 28 confronting surface with a semi-spherical hole;

the conical pin 29 through the hole of the holed-ball 23 has a conical fit with the end plate on the inner ring of the bearing and a cylindrical thread fit with the end cap 24;

pressure cap 33 to tighten the outer ring of the beating.

The inner ring of the double spherical centered bearing 30 is a spline hole and matching with the spline on the shaft;

the cylindrical pin formed by the two half cylinder pins 28 has a clearance fit with the blind hole in the bearing hub 30 in the radial direction of the cylinder;

the matching between the ball 23 with a hole and the recess formed by the half cylinder pin, the conical pin and the hole of the holed-ball is also clearance fit.

As discussed above, the end plate, the inner ring of the double spherical bearings, and the end cap, are integrated into a body "a" tightened by the conical pin. In the body "a" the outer ting of the double spherical centered bearing and the beating hub are integrated into another body "b" by pressure cap. There is a particular clearance between the two pairs of the confronting surfaces of bodies "a" and "b". The length of the cylindrical pin formed by the two half cylinder pins is less than the length of the blind hole matching to it, so a particular clearance is also formed between the two fitting surfaces.

The top surface of radial directional cylinder of the bearing hub construct is a non-continuous cylinder surface, and has a tight fit with hole of the rotatable plate.

The rotary movement is transferred to body "a" by the spline shaft, then to body "b" by "a", the conical pin 29, the ball 23 having a hole and the half cylinder pin 28, then to plate and the plate.

The axial movement of the floating plate rotational mechanism is obtained through the spline fit of the inner ring of the bearing and the spline shaft.

With the aforementioned four dimensional movement, body "b" could obtain a universal floating around the center of the double spherical centered bearing and the floating range of body "b" is the particular clearance of bodies "a" and "b". This clearance ensures that the ring shaped disks 27 remain parallel at working conditions.

Between body "a" and "b", there is a special sealing frame fitted to the circumference of both sides of the clearance. The special sealing frame is made of resilient material. Sealing glue is needed between the confronting surface of metal and the frame when the frame is mounted. An initial pressure P1 is needed after mounting. The sealing frame also could reset the floating body "b" by its elastic force.

The space at both sides of the radial cylinder of bearing hub and the space between the hole of the ring shaped plate and the outer ting of the bearing hub forms the passage way for the pulp to flow through.

The sealing of the support at the end of spline shaft 1 in the front end seat 107 is through the sealing parts or washers 54, 55, 56, 57 and the pushing plate without passage ways. The sealing of the support at the extending side/end of the spline shaft 1 in the tail end seat 108 is through the maze sealing structure constructed by bearing cap 7, comb structure 6, and two vack confronted U-shaped sealing rubber 51 and sealing blank 50.

The floating plate stator assembly 39 includes the following parts (FIGS. 7A, 7B and 7C): double lined centripetal ball bearing 35 with end cap 33 on the inner ring, stator plate 44 matching with the outer ring of the bearing by its opening, (axial pressure cap 33 for fixing the outer ring of the bearing), ring shaped disks 27 attached to both sides of the stator plate 44, inserted sealing washer 34 fitted in the gap between the hole of the stator plate 44 and the outer ring of the bearing.

The inner ring of the double lined centripetal ball bearing 35 is a spline hole that fits the spline shaft 1. The outer ring of the double lined centripetal ball bearing 35 is integrated with the stator plate 44 to a body by cap 33.

There is a particuliar clearance (68, 69) between the inner surface of the pressure cap 33 and the side surface of the outer ring of the bearing, and between the inner surface of the end plate of the bearing and the other side surface of the outer ring of the bearing. The gap with the inserted sealing washer 34 is also a special distance. There are a few rectangular flanges 76 on the outer ring 75 of the stator plate 44. The flange 76 fits in the groove 77 on the inner surface of the middle housing 48. The fitting surface of the flange 76 and the groove 77 is an arch; the driving arch is a rigid body and the other arch is an inserted resilient body 49.

The spline shaft 1 drives the inner ring of the bearing to rotate through the spline joint. The whole floating plate stator assembly 39 does not rotate but can move in the axial direction and float freely around its own center. The range of the floating movement is in the aforementioned clearance, and it can make sure that the ring shaped disks 27 and plates 44 remain parallel at working conditions. The inserted sealing washer also can reset the floating parts by its resilient force. There are several pulp passages in some areas of the hub of the stator plate 44.

The floating plate stator mechanism 39 (See FIGS. 2 and 7) includes the following parts:

double spherical centered bearing with end plate on inner ring;

stator plate 44 matching with the outer ring of the bearing by its hole;

axial pressure cap for fixing the outer ring of the bearing;

ring shaped disks 27 attached to both sides of the stator plate 44;

inserted sealing washer fitted in the gap between the hole of the stator 44 and the outer ring of the bearing, and the gap between the hole of the pressure cap and the outer ring of the bearing.

The inner ring of the double spherical centered bearing is a spline hole that fits the spline shaft. The outer ring of the double spherical centered bearing integrates with the auxiliary plate to a body by pressure cap.

There is a particular clearance between the inner surface of the pressure cap and the side surface of the outer ring of the bearing, and between the inner surface of the end plate of the bearing and the other side surface of the outer ring of the bearing. The gap with the inserted sealing washer is also special. There are a few rectangular flanges on the outer ring of the stator plates (See FIGS. 7A, 7B and 7C). The flange fits in the groove on the inner surface of the housing 48. The fitting surface of the flange and the groove is an arch. The driving arch is a rigid body and the other arch is an inserted resilient body. The spline shaft 1 drives the inner ring of the bearing to rotate through the spline joint. The whole floating plate stator mechanism does not rotate but can move in the axial direction and float freely around its own center.

The range of the floating movement is in the aforementioned clearance and it ensures that the ring shaped disks remain parallel at working conditions. The inserted sealing washer also can reset the floating parts by its resilient force. There are several pulp passages in some areas of the hub of the auxiliary plate.

There is a floating plate pushing mechanism and there is a pushing function and a floating theory. There are no pulp passages on the stator plate of the floating plate pushing mechanism, which is the left-most plate shown in FIG. 2. There is a resilient sealing washer with a spline hole on the side surface of the end plate on the inner ring of the bearing. The washer is glued to the outer surface of the end cap. Its resilient reset function is achieved by the sealing washer with conical hole that join the floating plate seat and the plate seat pusher.

Figure 8:
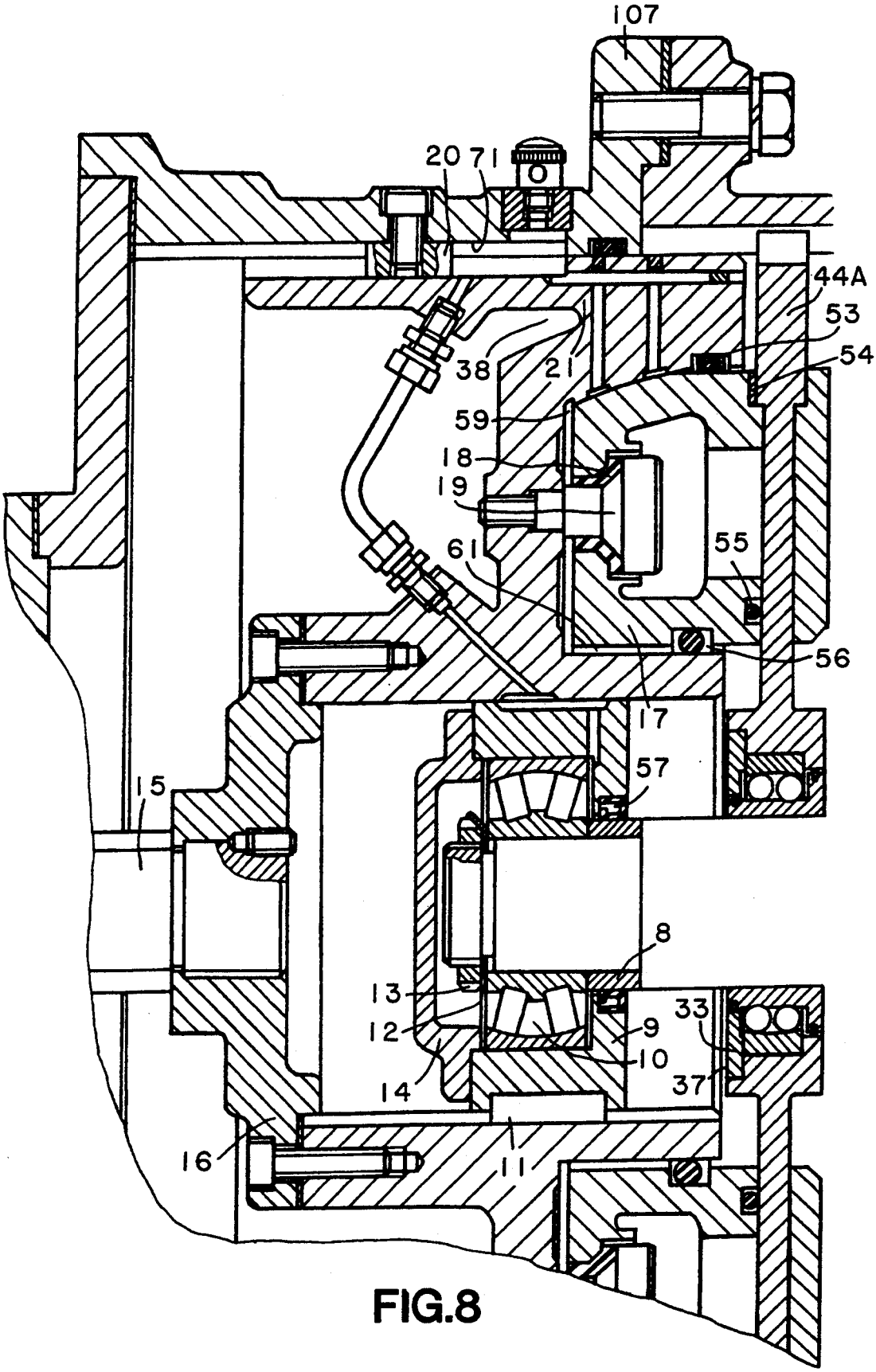
FIG. 8 is a vertical sectional view through the front end of the housing.
Figure 9:
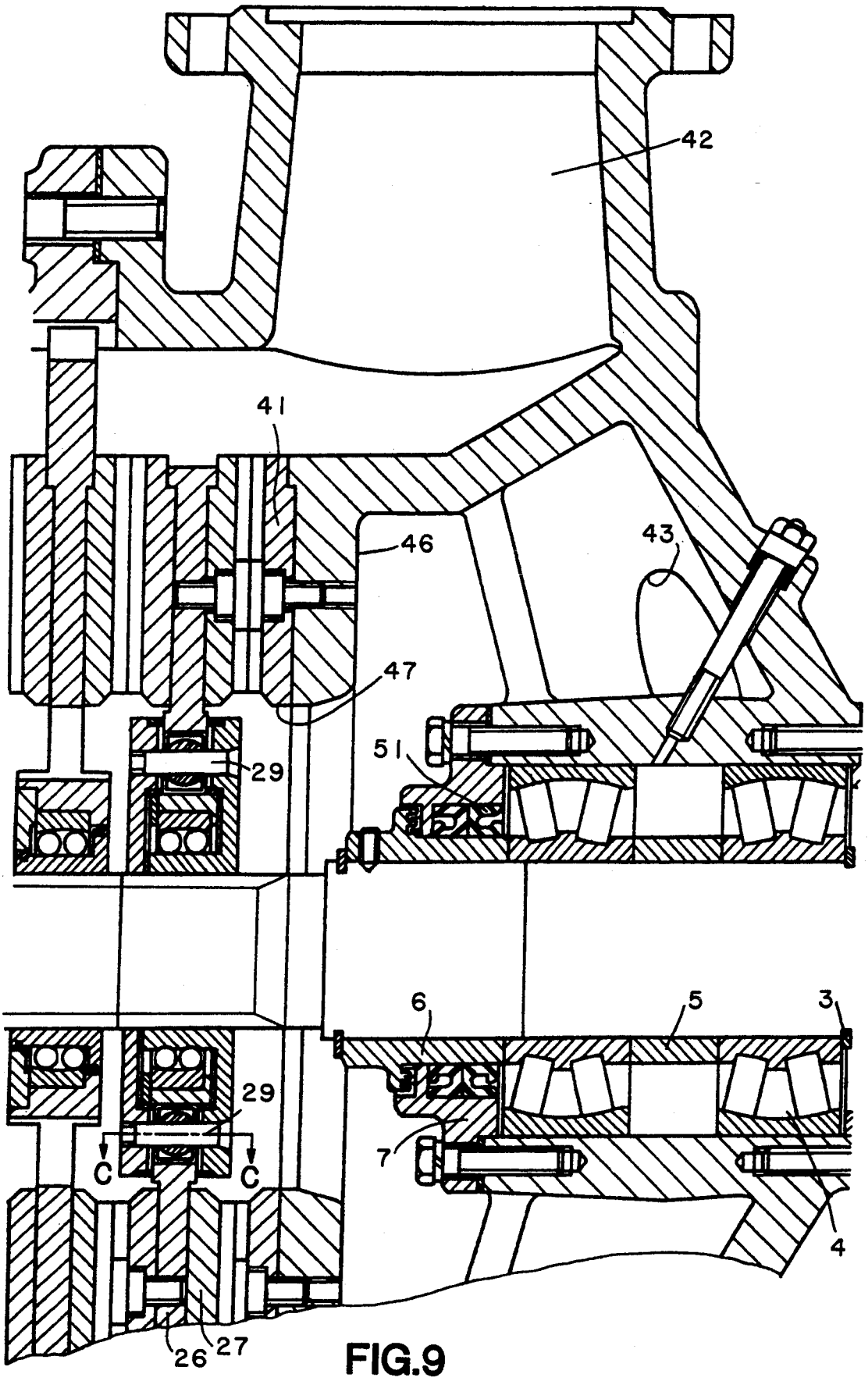
FIG. 9 is a vertical sectional view through the tail end of the housing.

The floating plate feeding pressurizer 38, as shown in FIGS. 2 and 8 illustrates the pushing function and the floating theory clearly:

1. There is no pulp passage on the stator plate 44A of the floating plate pushing mechanism 17.

2. There is a resilient sealing washer 37 with a spline hole on the outside surface of the plate mechanism. The washer 37 is glued to the outer surface of the end cap 33 of the left-most stator plate 44A so pulp cannot reach the floating plate pushing mechanism through the clearance of the spline fit.

3. The floating plate pushing mechanism 17 wobbles around the spherical center of the bearing in the floating plate stator mechanism mounted on the plate pushing seat.

4. The wobbling movement of the floating plate pushing mechanism 17 is shown in 59, 60. That clearance ensures that the plate could remain parallel at working conditions.

5. Sealing parts 53, 54, 55, 56 could insure that pulp can not flow in the floating plate pushing mechanism 17.

6. Its resilient reset function and axial position is achieved by the conical pin 19, the resilient washer 18 with conical hole that join the floating plate, and the plate seat pusher.

Among the advantages of the present invention are that the distance of the disk surface can be accurately controlled, so pulp beating pressure ratio, which is important to the quality of the pulp, can be controlled. Also, the housing assembly includes the front end seat 107, the tail end seat 108 and the middle housing 48. The fixed plate 41 is fastened to the inner end of the tail end seat 108. The position is fixed. The floating plate pushing mechanism 17 is installed in the opening of the front end seat 107 and can move in the axial direction under the control of the plate pushing pressurizer 38. Furthermore, it can make the plate mounted in its inner space float freely around its own spherical center, without rotating.

A few pairs of floating rotor plates 45 and floating stator plates 44 with disks attached to both sides are mounted to the spline shaft 1 next to each other within the housing 48. (Both the fixed plates and the floating plate pushing mechanism 17 are matched with the floating plate rotor assembly 40.)

The floating plate rotor assembly 40 can rotate under the driving of the spline shaft 1, move along the axle of the spline shaft and float freely around its own spherical center.

The floating plate stator assembly 39 can move along the axle of the spline shaft 1 and float freely around its own spherical center, but there is no rotary movement.

The plate attached to the mechanism described previously is manufactured with a fixed flange on its work face. Quite a few pulp grinding areas are formed between the work faces. A relative rotary movement can be achieved between the disks 27 attached to the sides of the floating rotor plates 45 and the disks 27 attached to the sides of the stator plates 44, which cannot rotate, and the fixed plate 41 when the floating rotor plates 45 are rotated by the driving spline shaft 1 so that pulp beating and grinding may be carried out.

The fixed plate and the plate attached to the floating plate mechanisms have the same size and the same ring appearance.

There are a few sector shaped passageways 72 on the spokes of the floating rotor plates 45 and the passageways 73 of the floating stator plates 44. The floating plate feeding pressurizer 38 has no passageways on its spokes. The feeder or entrance or inlet 43 is located on the side section of the tail end seat 108, and the unloader or outlet 42 is located on the top of the tail end seat 108. The feeder 43 and unloader 42 are separated. Pulp is loaded into the inner chamber 46 of the tail end seat 108 through the feeder 43. It passes through the opening 47 of the fixed plate 41, through the sector shaped passageways 72 and 73 on the spokes of the floating rotor and stator plates 72 and 73, and then reaches the work faces of the disks 27. As the process proceeds, the pulp passes from the central interior space in the plate openings 72 and 73 as well as other spaces, and feeds outwardly between the facing working surfaces on the disks 27. As the pulp is processed, it proceeds to the outer annular chamber 74 and then outwardly through the exit 42. The spline shaft 1 extends outwardly from the tail end seat 108 and is connected to the main motor through the shaft 109 and the pin coupling 102.

With the power supplied by the variable motor 101, the plate pushing pressurizer 38 could make the floating plate pushing mechanism 17 move in the axial direction through the screw bar 15 placed in the front end seat 107, thereby make the floating plate rotor assembly 40 and the floating plate stator assembly 39 move in the axial direction of the spline shaft under the pressure of the pulp.

At working conditions, the clearance between the working faces of the disks 27 can be controlled by the micrometer control assembly 105 when pressure is exerted. When this occurs, the three floating plate mechanisms 17, 39 and 40, aforementioned, will float freely under the pressure of the pulp, so an optimum parallel status can be achieved between the working faces of the disks.

In the housing 48, the spline shaft 1 is supported at the two ends of the floating plate assemblies and the position is fixed. The position of the supporter in the hole of floating plate pushing mechanism 17 seated in the front seat is fixed when the floating plate pushing mechanism 17 moves in the axial direction. The shaft and the parts attached to it is a suspension structure in the housing in the other plate refiners known so far. The two supports are located outside of the housing.

Compared with prior art plate refiners the shaft support in this invention has the following advantages:

(i). The loading condition of the two support structure is better than the suspension structure. It can provide stable movement and low power consumption.

(ii). Taking consideration of the free floating of the plate assembly, the two support structures make the shaft transfer only torque but not shear and stress. The machine is more compact.

(iii). The outer support of the suspension structure makes the machine much more complicated. The structure in this invention is simple thereby lowering the cost.

(iv). In suspension structures a pressured blanket sealing washer must be applied to the shaft journal. Long life and easy maintenance could be achieved in this invention because of no weariness in the new structure.

(v). There is no pulp leakage in the support structure in the invention.

Pulp beating is a complex physical and mechanical process. The squeezed stator and rotor plates will exert squeezing, fricting, shearing, impacting and stressing on the pulp, so the fiber will be subjected to bends, torque, rotating, tearing, scattering and splitting. The physical property has been changed to fulfill paper making specifications, there is an angle $\alpha$ (alpha) between the plates in traditional refiner. This causes the pulp to be sheared severely and fiber will be cut, so fiber length will be greatly reduced. As per FIG. 2, shearing in this invention is smaller compared with squeezing, fricting, impacting and stressing, so fiber length is longer than with the traditional technology and the quality is also superior when compared with the prior art technology. Comparing pulp beating results, the fiber length is raised by 200–300% in this invention as compared to a prior art one in experiments.

In China, the degree of beating is also called schopper riegler (SR). In the United States, Canadian Std. cc freeness (CSF) may be used as a standard unit. Beating degree raised by 7-016SR is an experimental result, and it is related to fiber character, beating method and productivity.

From the drawings, we know that there is no friction between the plates in this invention. 10–15% is an experimental result. Because there is no friction between the plates, the plates have a long life span. The disks are an easily damaged part in the refiner, and they usually must be changed frequently. Taking the value of the disk, this invention could lower the cost, and reduce the maintenance and part changing costs. The major maintenance activity is disk changing, and the spline connection between the plate assemblies and the main shaft 1 makes it easy to remove the plates after opening the front end seat 107.

When in the static condition the floating plates may be at any angle as long as there is enough space for them to be able to do so. However, under dynamic conditions the plates may be parallel to the fixed plate and the distance can be varied for example from less than 0.1 to 0.6 mm corresponding to the pressure ration and operating methods. The floating mechanism may rotate or move along the shaft, and furthmore, it can float around its spherical center on the axis.

As the pressurized pulp fills the device the floating plates move toward the fixed plate and the rotating floatable plate will become kinetically parallel to the fixed plate through the freely-floating movement under the equally-distributed pressure of the pulp. It is the floating plate that becomes parallel to the fixed plate. The fixed plate is taken as stationary datum plane. If there is only one pulp grinding area one of the two plates must be the fixed plate while the other is floatable so that the two keep parallel during working. If the two plates were fixed, it would descend to PFR. On the contrary if all the two plates were floatable, there would be no datum plane to parallelize the two plates.

Based on this, 'AFMR is nothing special but that with multiple working areas. No matter how many working areas, there must only be one fixed plate, and the others must have the floating ability. Under working conditions, the fixed plate is taken as original datum, to which the corresponding surface of the next plate (freely-floating plate) becomes parallel by the equally distributed pulp pressure. And the other floatable plates take turns to become parallel to their corresponding surface one after another.

One of the most important features of the present invention is the free wobbling function of the plate which comes from rigid parts with four free directions mounted on the plate's own center. This rigid structure is different from prior art structures.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. Apparatus for refining paper-making stock, comprising:
   a. a working chamber having an inlet and an outlet;
   b. shaft means arranged for rotation;
   c. means defining rotor means and stator means mounted on said shaft means and each including a plate having refining surfaces, the portions of said plates supporting said refining surfaces being capable of having a wobbling motion with respect to the portions of said plates mounted on said shaft means;
   d. said refining surfaces being axially spaced and arranged on said rotor plates to form an annulus and arranged on said stator plates to form an annulus;
   e. said inlet providing stock into the interior of the plates and refining surfaces, and said outlet being located at the outer periphery of the chamber for collecting separated stock after it has passed between the refining surfaces on said plates.

2. Apparatus for refining paper-making stock as defined in claim 1 wherein the portions of said plates mounted on said shaft means are at right angles with respect to the shaft means at all times.

3. Apparatus for refining paper-making stock as defined in claim 2, wherein the portions of said plates on which the refining surfaces are located are capable of moving at an angle with respect to the position of said first portions of said plates and the rotor plates and stator plates remain parallel with respect to one another.

4. Apparatus for refining paper-making stock as defined in claim 1 wherein the refining surfaces are capable of having a freely wobbling motion with respect to the portions of said plates mounted on said shaft means.

5. Apparatus for refining paper-making stock, comprising:
   a. a working chamber having an inlet and an outlet;
   b. rotor means and stator means inside said chamber;
   c. axially spaced refining disks having working surfaces arranged to form an annulus and mounted on said rotor and stator means, and each of which is movable to a position at an angle with the longitudinal axis of the apparatus; and
   e. said inlet providing stock into the interior of the plates and refining surfaces, and said outlet being located at the outer periphery of the chamber for collecting separated stock after it passes between the working surfaces on said annular surfaces.

6. Apparatus for refining paper-making stock as defined in claim 5, wherein the refining disks are each freely movable to a position at an angle with the longitudinal axis of the apparatus.

7. An apparatus for reducing particulate materials such as paper-making pulp, comprising:
   a. a housing defining a working chamber having an inlet and an outlet for flow of particulate material therethrough;
   b. rotary shaft means supported in said housing;
   c. rotor means and stator means mounted on the shaft means within said working chamber;
   d. radially extending annular rigid refining surfaces mounted on the outer portions of said rotor plates and stator plates; and
   e. said rotor plates and stator plates providing complementary rigid refining surfaces mounted in said chamber and cooperating in confronting relation with said refining surfaces so that in the relative rotation of said refining surfaces particulate material flowing through said working chamber and between said refining surfaces is refined.

8. Apparatus for refining paper-making stock as defined in claim 7, wherein the portions of said plates supporting said refining surfaces are capable of having a wobbling motion with respect to the portions of said plates mounted on said shaft means.

9. Apparatus for refining paper-making stock as defined in claim 8, wherein the positions of said plates mounted on said shaft means are at right angles with respect to the shaft at all times.

10. Apparatus for refining paper-making stock as defined in claim 9, wherein the portions of said plates on which the refining surfaces are located are capable of moving at an angle with respect to the position of said first portions of said plates and the rotor plates and stator plates remain parallel with respect to one another.

11. Apparatus for refining paper-making stock comprising:
   a. a working chamber having an inlet and an outlet;
   b. rotor means and stator means inside said chamber;
   c. axially spaced refining disks having working surfaces arranged to form an annulus and mounted on said rotor and stator means, and each of which is movable to a position at an angle with the longitudinal axis of the apparatus;
   e. said inlet providing stock into the interior of the plates and refining surfaces, and said outlet being located at the outer periphery of the chamber for collecting separated stock after it passes between the working surfaces on said annular surfaces; and
   f. bearing means for mounting the plates onto the shaft and having an inner race and an outer race; and the portions of said plates supporting said refining surfaces being capable of having a wobbling motion with respect to the portions of said plates mounted on said shaft means, the positions of said plates mounted on said shaft means being at right angles with respect to the shaft at all times, wherein the portions of said plates on which the refining surfaces are located are capable of moving at an angle with respect to the position of said first portions of said plates and the rotor plates and stator plates remain parallel with respect to one another.

12. Apparatus for refining paper-making stock as defined in claim 11, wherein each plate includes two parts, the first including the inner race of the bearings means and arranged to remain at right angles to the shaft at all times, and the second of which includes the outer race which is movable longitudinally of the shaft to permit the plates to assume positions which are at an angle other than a right angle with respect to the shaft.

13. Apparatus for refining paper-making stock as defined in claim 12, wherein the inner surface of the outer race is curved to permit movement thereof with respect to the inner race.

14. Apparatus for refining paper- making stock as defined in claim 13, wherein there are balls between the inner race and the outer race.

15. Apparatus for refining paper-making stock as defined in claim 14, wherein there are clearances between the two parts to permit relative movement between them.

16. Apparatus for refining paper-making stock as defined in claim 15, wherein the plates are arranged to be able to wobble with respect to the shaft means.

17. Apparatus for refining paper-making stock, comprising:

a. a working chamber having an inlet and an outlet;

b. shaft means arranged for rotation;

c. means defining rotor means and stator means mounted on said shaft means and each including a plate, the portions of said plates supporting said refining surfaces being capable of having a wobbling motion with respect to the portions of said plates mounted on said shaft means;

d. axially spaced refining surfaces arranged on said rotor plates to form an annulus and arranged on said stator plates to form an annulus;

e. said inlet providing stock into the interior of the plates and refining surfaces, and said outlet being located at the outer periphery of the chamber for collecting separated stock after it has passed between the working surfaces on said surfaces of said plates; and f. bearing means for mounting the plates onto the shaft and having an inner race and an outer race.

* * * * *